United States Patent [19]

Figone et al.

[11] Patent Number: 4,834,212

[45] Date of Patent: May 30, 1989

[54] SOUND MUFFLER FOR COVERING THE MOUTH

[76] Inventors: Moira J. Figone; Frank M. Figone, both of 1105 Alomar Way, Belmont, Calif. 94002

[21] Appl. No.: 32,034

[22] Filed: Mar. 30, 1987

[51] Int. Cl.[4] ..... G10K 11/00

[52] U.S. Cl. ..... 181/242; 181/21; 181/175; 381/158; 381/169

[58] Field of Search ..... 181/21, 138, 242, 18, 181/19, 175; 381/91, 110, 122, 158, 169

[56] References Cited

U.S. PATENT DOCUMENTS

| | | | |
|---|---|---|---|
| 1,776,584 | 9/1930 | Gerlach, Jr. | 181/242 |
| 2,485,278 | 10/1949 | Gilmen et al. | 181/242 X |
| 2,882,355 | 4/1959 | Webb | 181/21 X |
| 4,129,754 | 12/1978 | Gore | 181/242 X |

*Primary Examiner*—B. R. Fuller

*Attorney, Agent, or Firm*—Flehr, Hohbach, Test, Albritton & Herbert

[57] ABSTRACT

A human sound muffler and indicator for placement around the mouth of a user to absorb most of the sound emanating from the user's mouth including a microphone and associated electrical circuit for receiving unabsorbed sound and providing an indication of the intensity of the unabsorbed sound.

4 Claims, 3 Drawing Sheets

SOUND MUFFLER FOR COVERING THE MOUTH

This invention relates generally to a sound muffler for covering the mouth and more particularly to a sound muffler which also measures the intensity of sound.

Many of use become so frustrated by some task that we are undertaking that we would like to "scream". Others of us get angry at another person, happening, event, or the like, so mad that we would like to vent our anger by screaming or yelling. We generally suppress the desired because we would look foolish and also disturb others.

There is a need in our complex society for a device which can be placed over the mouth and into which a person may yell or scream but which muffles the sound so others are not disturbed. Such a device would even be more useful if it provided an indication of the intensity of the sound thereby providing feedback to the user.

It is a general object of the present invention to provide a sound muffler which can be placed over the mouth to receive and muffle sound from the mouth. It is a further object of the present invention to provide a sound muffler which provides means for measuring and indicating the intensity of the sound which is muffled.

There is provided, in accordance with the invention, a human sound muffler which comprises a body adapted to be grasped and manipulated by a user, said body including a shaped end adapted to fit snugly over the mouth of the user and engage the face around the mouth. The face engaging end preferably comprising compliant sound absorbing material, whereby it forms an effective seal around the mouth.

The foregoing and other objects of the invention will be clearly understood from the following description taken in connection with the accompanying drawings of which:

Figure 1:
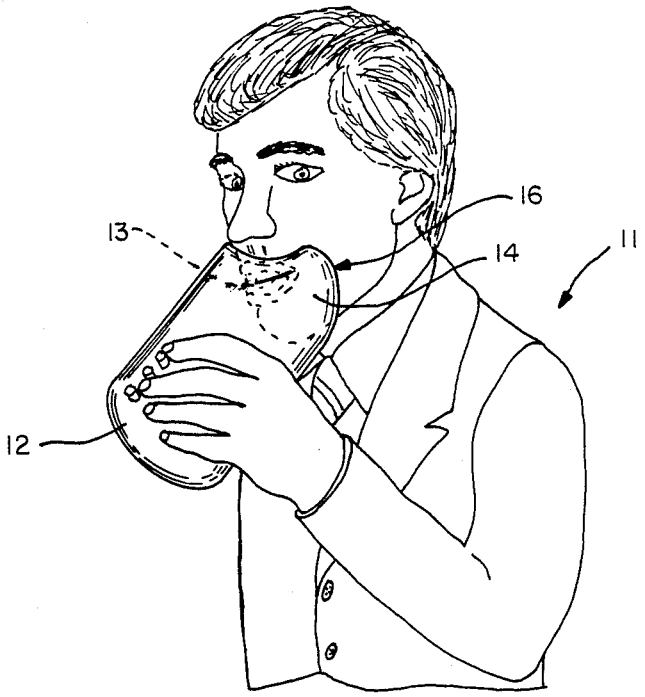
FIG. 1 shows a person using a sound muffler in accordance with the present invention.

Referring to FIG. 1, user 11 is holding a sound muffler 12 over his mouth 13 with the end 14 of the muffler straddling the mouth and forming a seal with the adjacent face portions 16.

Figure 2:
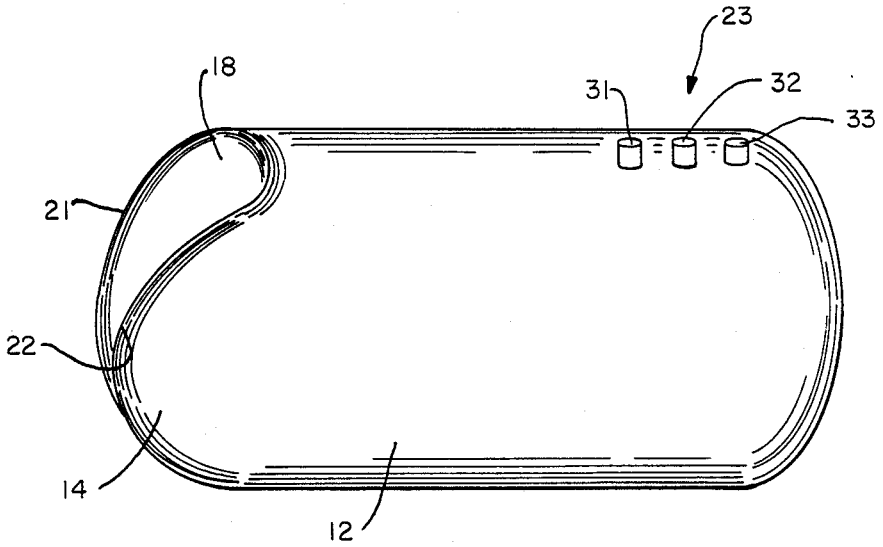
FIG. 2 is a perspective view of a sound muffler in accordance with the invention.
Figure 3:
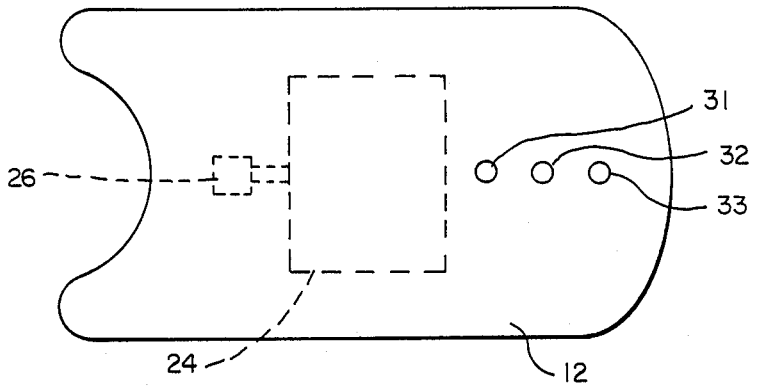
FIG. 3 is a top plan view of the sound muffler.

Referring more particularly to FIG. 2, the end 14 of the muffler 12 is saddle shaped as shown at 18. The shape is such that the two sides 21 and 22 straddle the mouth of the user and engage the adjacent face portions. Preferably at least the interior portion of the end 14 of the muffler is made of relatively compliant foam or similar material to conform to the shape of the face and improve the sealing of the device to the face of a user. The compliant foam material is selected so as to also be sound absorbing whereby it not only seals the sound by engaging the face of the user, but also absorbs the sound waves to deaden the sound. The combination of the saddle shaped end which straddles the face, and the use of a compliant material such as foam, provides an extremely efficient sound deadening device. Thus, the user 11 who wishes to vent his anger or frustration may pick up the device, place it on his face whereby it straddles the mouth and engages the face, and then can yell into the device which serves to receive and deaden the sound and prevent the sound from disturbing others in the vicinity.

In accordance with another feature of the invention, there is provided a means for measuring the intensity of the sound and providing a visual indication of the intensity thereby giving the user feedback. Referring particularly to FIG. 2, the feedback is by means of three lights 23 which may for example be yellow, red and green, showing various degrees of intensity. The lights are associated with an electronic circuit 24 encapsulated in the device 12 as shown in dotted line in the figures. A microphone 26 is placed to receive sound before it is entirely deadened and to transduce the sound into electrical signals which are processed to provide the desired indication.

Figure 5:
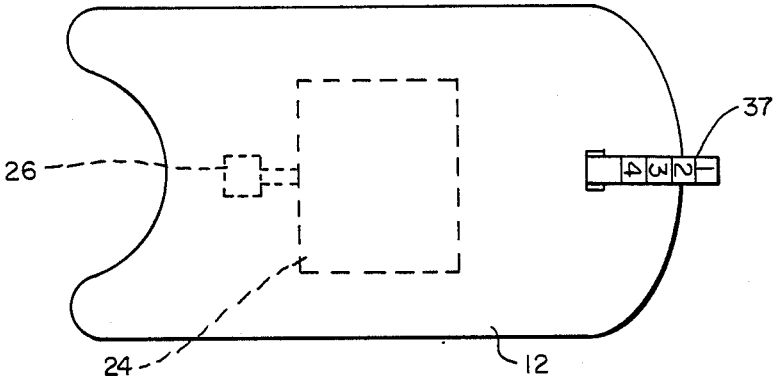
FIG. 5 is a top plan view showing still another embodiment of the invention.
Figure 6:
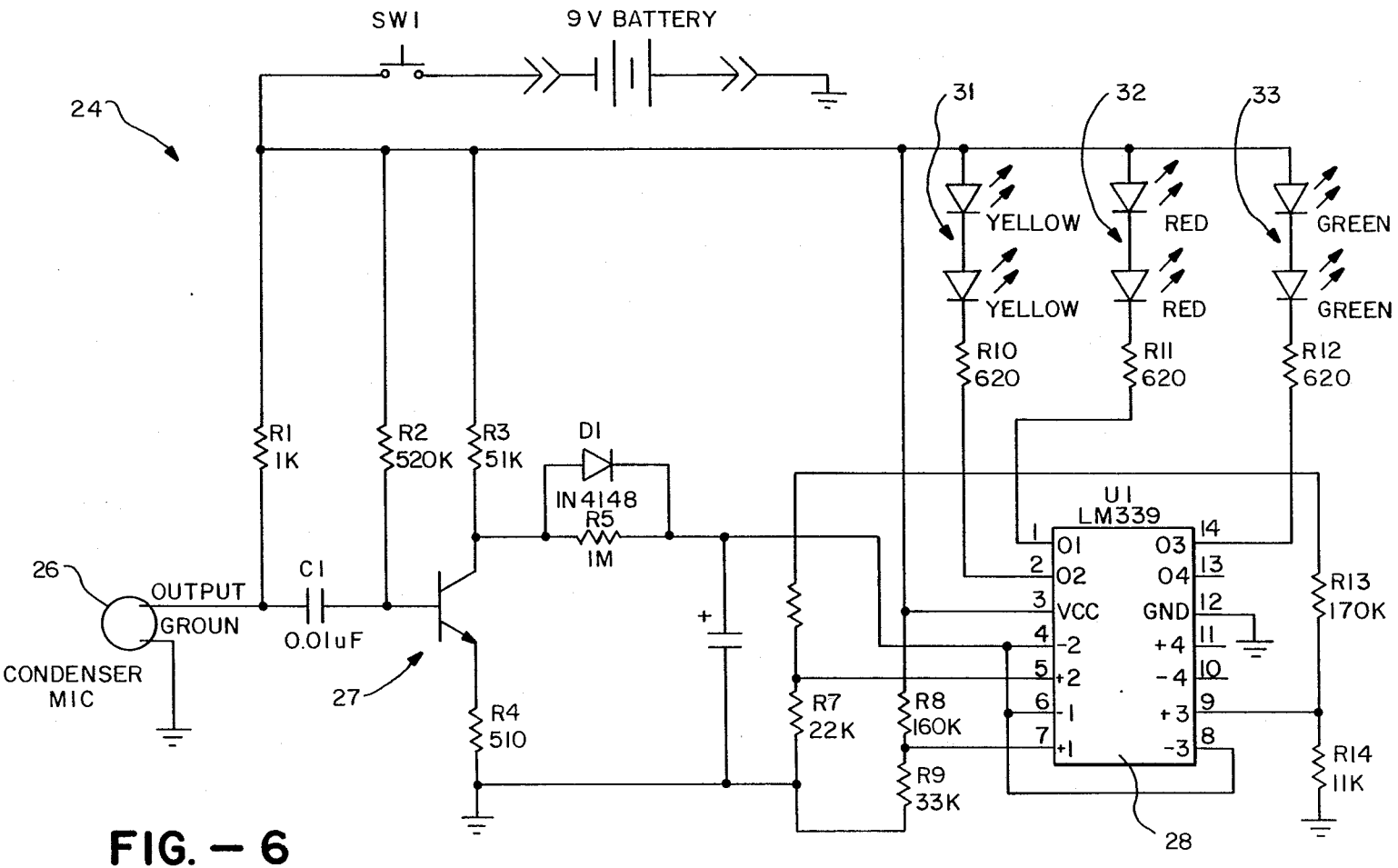
FIG. 6 is a schematic diagram showing a sound measuring display circuit for use in connection with the present invention.

A suitable circuit 24 is shown in FIG. 5 which shows microphone 26 connected to an amplifier 27 which in turn is connected to a integrated circuit 28 for example an LM339 available from Texas Instruments. The circuit 28 serves to receive the amplified signals from the amplifier, process the signals and provide one of three outputs depending on the intensity of the sound whereby the green, yellow or red lights 31-33 are illuminated to provide the user with an indication of the intensity of the sound. The drawing shows the values of the circuit components used in a circuit used in a prototype sound muffler.

Figure 4:
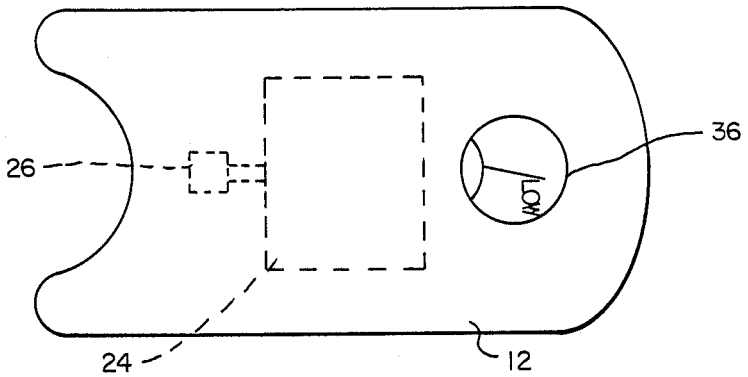
FIG. 4 is a top plan view showing another embodiment of the invention.

Rather than energizing lights, the circuit may be used to provide an analog signal which drives a meter such as the meter 36 FIG. 4. Likewise the output may be used to drive a printer which provides a printed indication of the intensity of the sound as shown at 37 FIG. 5.

It is apparent that a mechanical mechanism may be employed to provide an indicator of the intensity of the sound.

Thus there has been provided a sound muffler and sound measuring device which can be used to reduce anger and frustration and which provides feedback to the user.

We claim:

1. A human sound muffler and indicator comprising a unitary body adapted to be grasped and manipulated by a user, at least one end of said body comprising a saddle shaped body of compliant sound absorbing foam material adapted to fit over the mouth of a user and engage the face around the mouth to form an effective sound seal to receive sound directly from the mouth and absorb substantially most of the sound in the foam material, a microphone for receiving unabsorbed sound disposed adjacent the bottom of said foam saddle and providing an output signal responsive to the unabsorbed sound, and means in said body for receiving said output signal and providing an indication on said body of the intensity of the unabsorbed sound.

2. A human sound muffler as in claim 1 in which said means providing an indication of the intensity of the unabsorbed sound comprises lights.

3. A human sound muffler as in claim 1 in which said means providing an indication of the intensity of the unabsorbed sound is an analog meter.

4. A human sound muffler as in claim 1 in which said means providing an indication of the intensity of the unabsorbed sound is a printer.

* * * * *